US005282584A

United States Patent [19]

Yano

[11] Patent Number: 5,282,584

[45] Date of Patent: Feb. 1, 1994

[54] BELT-LIKE MATERIAL WINDING SYSTEM

[75] Inventor: Eiji Yano, Musashimurayama, Japan

[73] Assignee: Bridgestone Corporation, Tokyo, Japan

[21] Appl. No.: 896,369

[22] Filed: Jun. 10, 1992

[30] Foreign Application Priority Data

Jun. 18, 1991 [JP] Japan ..... 3-171816

[51] Int. Cl.[5] ..... B65H 18/10

[52] U.S. Cl. ..... 242/67.2

[58] Field of Search ..... 242/67.2, 67.3 R, 67.1 R, 242/67.5, 78.1

[56] References Cited

U.S. PATENT DOCUMENTS

| | | | |
|---|---|---|---|
| 4,103,840 | 8/1978 | Dowd | 242/67.3 R |
| 4,695,005 | 9/1987 | Gietman | 242/67.2 |
| 4,951,892 | 8/1990 | Chaplin et al. | 242/67.3 R X |
| 5,069,394 | 12/1991 | Panttila et al. | 242/67.1 R |
| 5,194,107 | 3/1993 | Okuyama et al. | 242/67.2 X |

FOREIGN PATENT DOCUMENTS

| | | | |
|---|---|---|---|
| 484832 | 2/1973 | Japan | 242/67.2 |

*Primary Examiner*—John M. Jillions

*Attorney, Agent, or Firm*—Sughrue, Mion, Zinn, Macpeak & Seas

[57] ABSTRACT

A winding system for winding up a long belt-like material 9 which is fed in a continuous manner, onto a take-up shaft 61. The winding system is provided with a guide belt conveyor for guiding front and rear ends of the belt-like material 9 each up to a predetermined position on the take-up shaft 61, and a dancer roller 18 for applying a certain tension to the belt-like material being wound up onto the take-up shaft. The take-up shaft is mounted on a platform car 60 capable of traveling and it comes into engagement with the winding drive shaft 52 and is thereby rotated. When the platform car 60 is to be changed for another like platform car, the winding drive shaft 52 is retracted in a direction perpendicular to the traveling direction of the platform car to be changed.

2 Claims, 7 Drawing Sheets

BELT-LIKE MATERIAL WINDING SYSTEM

BACKGROUND OF THE INVENTION

The present invention relates to a winding system for winding up a long and soft belt-like material which is, for example, the material of the tread or side walls of a tire, onto a take-up shaft.

FIG. 10 is a schematic side view showing an example of a conventional winding system. A belt-like material 01 is fed to a take-up shaft 02 by means of a front conveyor 03 and is wound up onto the take-up shaft. The belt-like material 01 fed out of a front end portion of the conveyor 03 passes a dancer roller 04 before reaching the take-up shaft 02 and is wound up onto the take-up shaft while being kept under a certain tension by the dancer roller 04.

At the same time, liner 07 is fed from a liner supply roll 05 through a rolls 06 and is wound up onto the take-up shaft 02 together with the belt-like material 01.

The take-up shaft 02 is mounted on a platform car (not shown). As the platform car travels along a predetermined path, the take-up shaft 02 is conveyed to a predetermined position where a winding drive shaft is disposed. In this position, rotation is transmitted to the take-up shaft 02 from the winding drive shaft to perform a winding operation. When the winding operation is over, the platform car moves back along the predetermined path and alternates with the next platform car.

In starting the take-up of the belt-like material 01 onto the take-up shaft 02, as shown in FIG. 11, the dancer roller 04 is in a raised position so as not to operate, and a front end 01*a* of the belt-like material 01 hangs down from the front conveyor 03 and is fed to the take-up shaft 02 from above. Therefore, upon contact of the front end 01*a* with the take-up shaft 02, the front end may be bent in the direction opposite to the rotating direction and wound up onto the take-up shaft, as shown in FIG. 12.

Also, when a rear end portion 01*b* of the belt-like material 01 is wound up, there is a fear of the rear end portion being bent in the rotating direction of the take-up shaft 02 and winding operation being terminated in the bent state of the rear end portion, as shown in FIG. 13.

According to the prior art, moreover, the platform car advances up to the winding system and, upon completion of the winding operation, moves back along the same path, so the next platform car must wait until the preceding platform car goes out. Thus, the change of platform cars is not performed efficiently.

SUMMARY OF THE INVENTION

The present invention has been accomplished in view of the aforementioned point and it is the object of the invention to provide a winding system capable of winding up a belt-like material without bending of front and rear ends of the belt-like material and which permits an efficient change of platform cars.

According to the present invention there is provided a winding system for winding up a long belt-like material being fed continuously onto a take-up shaft, including guide means for guiding front and rear ends of the belt-like material each up to a predetermined position on the take-up shaft, and a dancer roller for applying a predetermined certain tension to the belt-like material.

Since the guide means guides the front and rear ends of the belt-like material each up to a predetermined position on the take-up shaft, there is no fear of both ends being bent when wound up onto the take-up shaft.

According to the present invention there is also provided a winding system for winding up a long belt-like material being fed continuously onto a take-up shaft, including retraction means for retracting a winding drive shaft which drives the take-up shaft in a direction orthogonal to a traveling direction of a platform car provided with the take-up shaft at the time of change of the platform car for the next like platform car.

Since the platform car after the winding operation can move ahead without moving back because the winding drive shaft is retracted, thus permitting the next platform car to enter the winding place immediately, it is possible to effect the change of platform cars efficiently.

DETAILED DESCRIPTION OF A PREFERRED EMBODIMENT

An embodiment of the present invention will be described hereinunder with reference to FIGS. 1 to 9.

Figure 1:
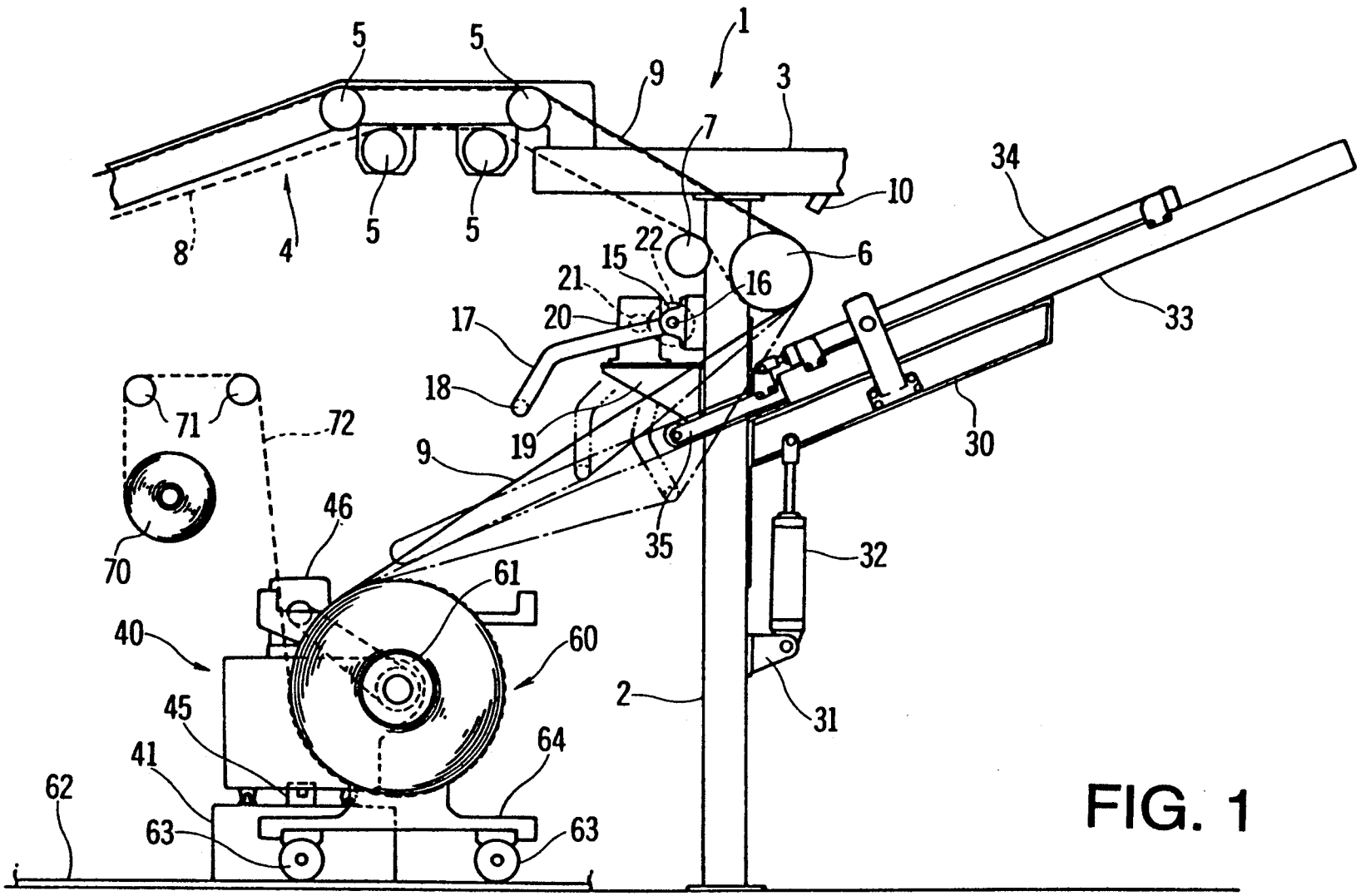
FIG. 1 is a side view of the whole of a winding system according to an embodiment of the present invention.

FIG. 1 is a side view of the whole of a winding system 1 embodying the invention. A pair of support posts 2 are erected side by side in a longitudinal direction, namely, in a direction perpendicular to the paper surface. To the upper end of each support post 2 is fixed a horizontal member 3, and a conveyance device 4 is connected to the left end portions of the horizontal members 3.

A conveyor belt 8 entrained about rollers 5 disposed in predetermined positions of the conveyance device 4 and rollers 6 and 7 mounted to the upper portions of the support posts 2. A belt-like material 9 made of rubber is conveyed by the conveyor belt 8. The horizontal members 3 are each provided with a photosensor 10 in proximity to the roller 6 to detect front and rear ends of the belt-like material 9 fed by the conveyance device 4.

The front and rear support posts 2 are each provided with a bearing 15 in a suitable position, and a rotatable shaft 16 is supported by the bearings 15. To the rotatable shaft 16 is fixed a base end portion of a dancer roller member 17, which swings as the rotatable shaft 16 rotates. A free end portion of the dancer roller member hangs down and supports a dancer roller 18 rotably.

Below the bearings 15 is provided a bracket 19 in a leftwards projecting state, and a motor 20 is mounted on the bracket 19. A gear 21 fitted on a driving shaft of the motor 20 is in mesh with a gear 22 fitted on the rotatable shaft 16. Therefore, the dancer roller member 17 can be allowed to swing up and down by means of the motor 20.

To the support post 2 is attached vertically slidably a lift member 30 which is projecting rightwards and obliquely upwards. The lift member 30 is connected to the upper end of an upwardly projecting cylinder rod of a lift cylinder 32 which is supported by a bracket 31. Upon operation of the lift cylinder 32, the lift member 30 moves vertically.

To the lift member 30 is fixed a long guide member 33 along the upper surface of the lift member, and an advancing cylinder 34 is provided along the guide member 33. Further, there is provided a guide belt conveyor 35 capable of advancing leftwards in the figure along the upper surface of the lift member 30 while being guided by the guide member 33. A front end of a cylinder rod of the advancing cylinder 34 is connected to one side portion of the guide belt conveyor 35 in a position near a front end of the conveyor projecting from the guide member 33. Therefore, the guide belt conveyor 35 is moved forward and backward by means of the cylinder 34.

The guide belt conveyor has a belt conveyor which is driven by means of an air motor (not shown) . The speed of the belt conveyor can be set higher or lower than the conveying speed of the conveyance device 4.

Thus, the guide belt conveyor 35 is moved vertically in an obliquely tilted state by means of the lift cylinder 32, moved forward and backward by the advancing cylinder 34, and drives the conveyor belt by itself using the aforesaid air motor.

Figure 2:
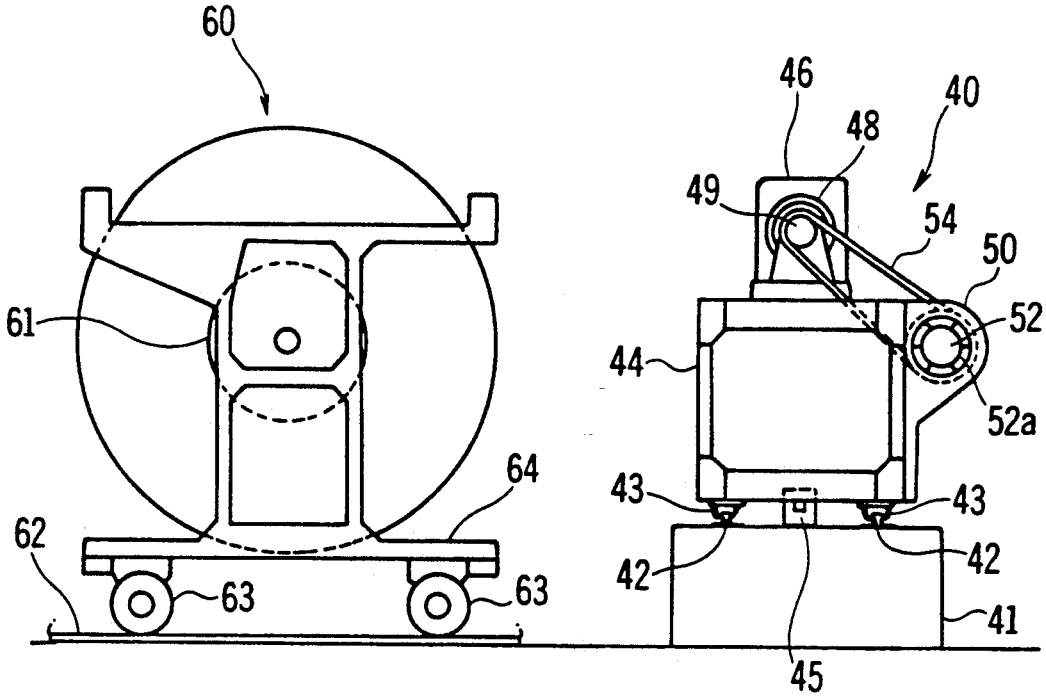
FIG. 2 is a side view of a winding drive unit and a platform car.
Figure 3:
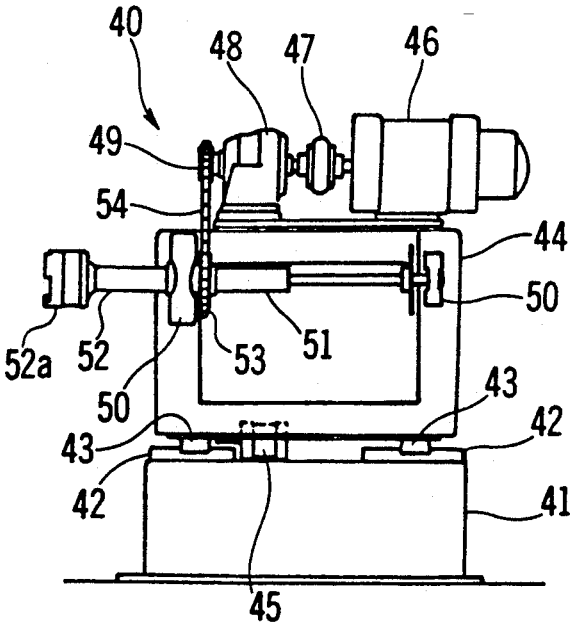
FIG. 3 is a rear view of the winding drive unit.

Below the conveyance device 4 is disposed a winding drive unit 40. As shown in FIGS. 2 and 3, rails 42 are laid longitudinally on a base 41, and a support frame 44 is supported by the rails 42 slidably longitudinally through sliders 43. Onto the base 41 is fixed a cylinder 45, and a front end of its cylinder rod is fixed to the support frame 44. The support frame 44 slides longitudinally upon operation of the cylinder 45.

A motor 46 is mounted on the top of the support frame 44, and a driving shaft thereof is connected to an input shaft of a reduction unit 48 through a coupling 47. A sprocket 49 is fitted on an output shaft of the reduction unit 48. Bearings 50 are projecting in front and rear positions from one side face of the support frame 441, and a rotatable shaft 51 is supported rotatably by the bearings 50. The rotatable shaft 51 further projects forward to form a winding drive shaft 52, with a connection 52*a* being formed at a front end of the shaft 52. A chain 54 is stretched between a sprocket 53 fitted on the rotatable shaft 51 and sprocket 49.

The winding drive shaft 52 is rotated by the motor 46 and is moved back and forth together with the support frame 44 by means of the cylinder 45.

A platform car 60 travels right- and leftwards in front of the winding drive unit 40. A take-up shaft 61 is supported rotatably by the platform car 60. More specifically, rails 62 are laid in the transverse direction, and a support member 64 for the platform car 60 is supported on the rails 62 through wheels 63 so that it can travel right- and leftwards. Further, the take-up shaft 61 is rotatably mounted longitudinally on the support member 64. A connection 61*a* formed at a rear end of the take-up shaft 61 comes into engagement with the connection 52*a* formed on the winding drive shaft 52 of the winding drive unit 40.

Figure 4A:
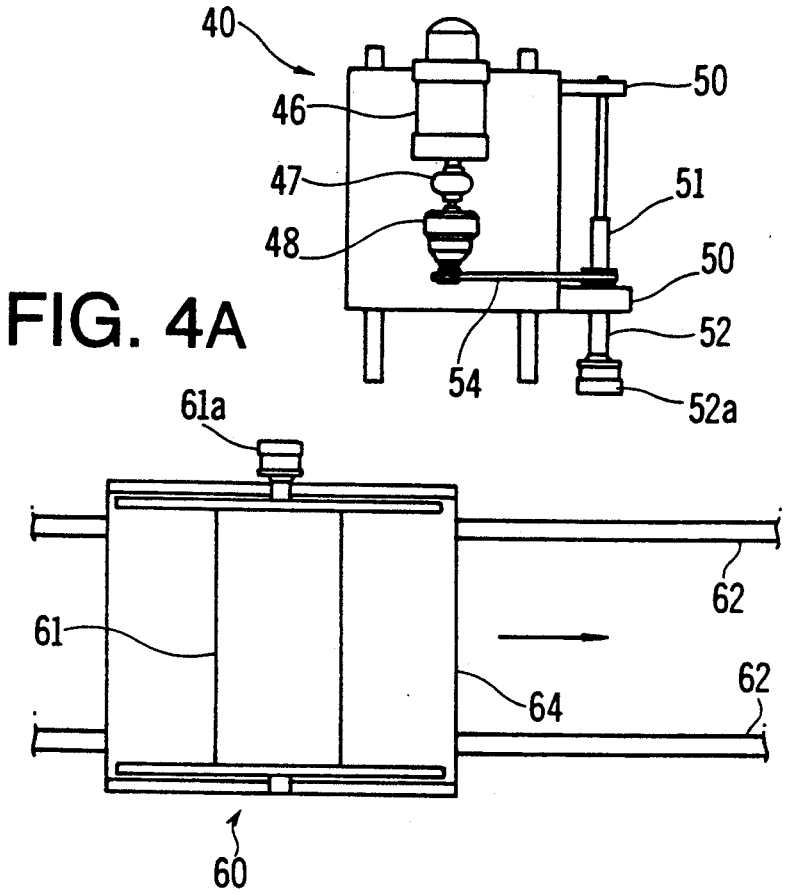
FIGS. 4A and 4B are plan views for explaining movements of the winding drive unit and the platform car.
Figure 4B:
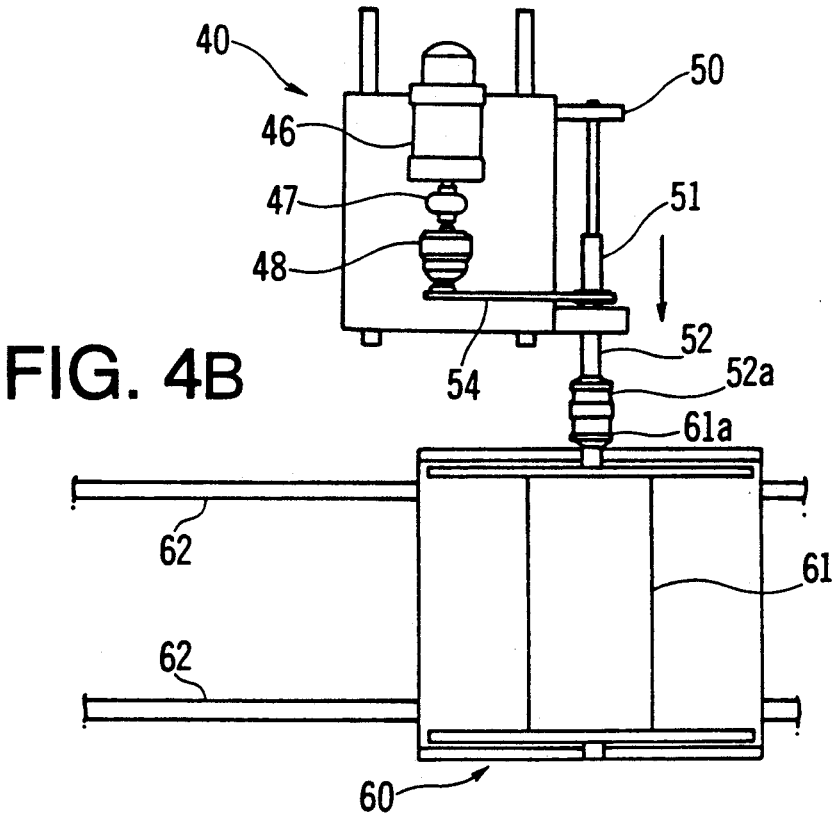

As shown in FIG. 4A, the platform car 60 moves from the left-hand side to the position located in front of the winding drive unit 40 and stops when the take-up shaft arrives at the position opposed to the winding drive shaft 52. Then, the support frame 44 of the winding drive unit 40 is driven by the cylinder 45 and moves forward, so that the connection 52*a* of the winding drive shaft 52 comes into engagement with the connection 61*a* of the take-up shaft 61 provided on the platform car 60 side (see FIG. 4B)

When the motor 46 is operated in this state, the rotation of the motor is transmitted to the take-up shaft 61 through the chain 54 and the winding drive shaft 52, so that the take-up shaft 61 rotates, thus permitting the belt-like material to be wound up around the shaft 61.

When the belt-like material 9 winding operation is over, the cylinder 45 operates and the winding drive shaft 52 retracts backward to disconnect the shaft 52 and the take-up shaft 61 from each other. Then, the platform car 60 further travels rightwards and the next platform car comes in from the left-hand side.

Thus, since the winding drive shaft 52 can retract backward, the traveling path of the platform car 60 is one-way only, coming in from the left-hand side and going out to the right after the end of the winding operation. Unlike the prior art, therefore, it is not necessary for a preceding platform car to move back after the end of the winding operation and for the next platform car to wait until the preceding platform car goes out. That is, the change of platform cars can be done efficiently.

In winding the belt-like material 9, liner 72 is fed from a liner roll 70 through rollers 71 and is wound up together with the belt-like material 9.

The following description is now provided about a winding process for the belt-like material 9 in the winding system 1, with reference to FIGS. 5 to 9.

Before the belt-like material 9 is fed by the conveyance device 4, the guide belt conveyor 35 is in its raised and retracted position, and the front end thereof is positioned just under the roller 6. The dancer roller 18 is in its raised position.

Figure 5:
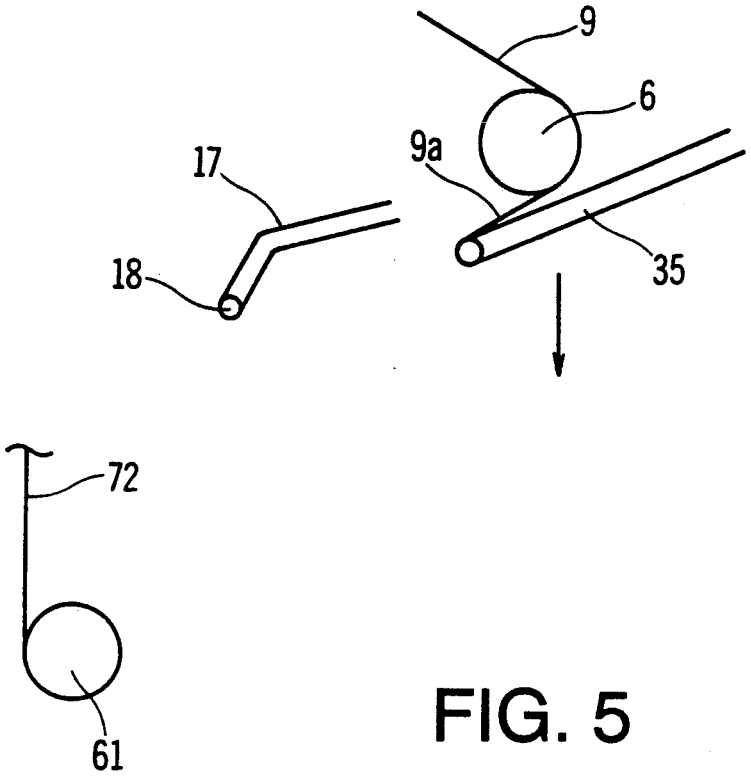
FIGS. 5 to 9 are explanatory views showing operating steps of a winding process.

When the belt-like material 9 is conveyed by the conveyor belt 8 of the conveyance device 4, the photosensor 10 disposed near the roller 6 detects the front end of the belt-like material, whereupon the belt of the guide belt conveyor 35 is driven and the front end of the belt-like material 9 hanging down from the roller 6 is received by the belt. At this time, since the conveying speed of the guide belt conveyor 35 is set higher than that of the conveyance device 4, the front end, indicated at 9*a* of the belt-like material 9 received by the conveyor 35 is pulled in the conveying direction of the conveyor 35 (FIG. 5).

Figure 6:
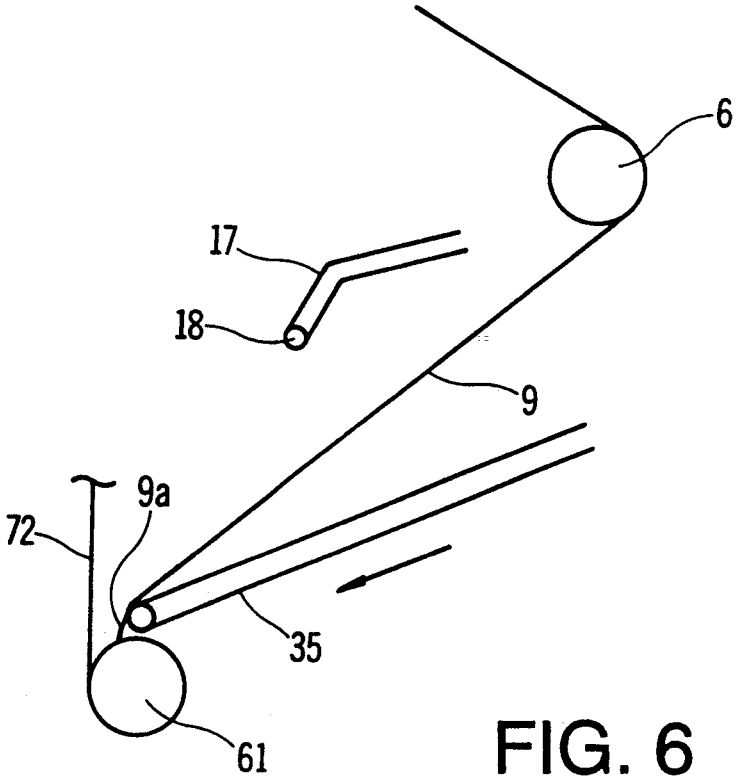

Then, the guide belt conveyor 35 goes down and extends toward the take-up shaft 61 to guide the front end 9*a* of the belt-like material 9 up to a predetermined loading position on the take-up shaft 61 and load it onto the same shaft from that position (FIG. 6). In this way the front end 9*a* of the belt-like material 9 can be loaded onto the take-up shaft 61 in an optimum position not causing bending of the front end, so the foregoing inconvenience caused by bending of the front end will never occur. The belt-like material 9 is taken up together with the liner 72.

Figure 7:
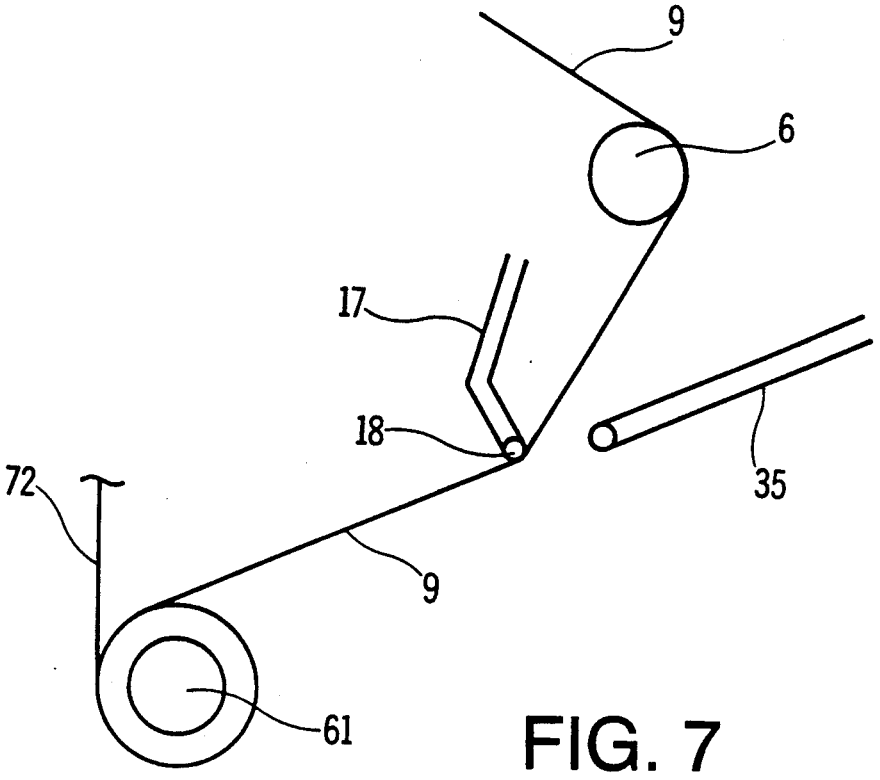
Figure 8:
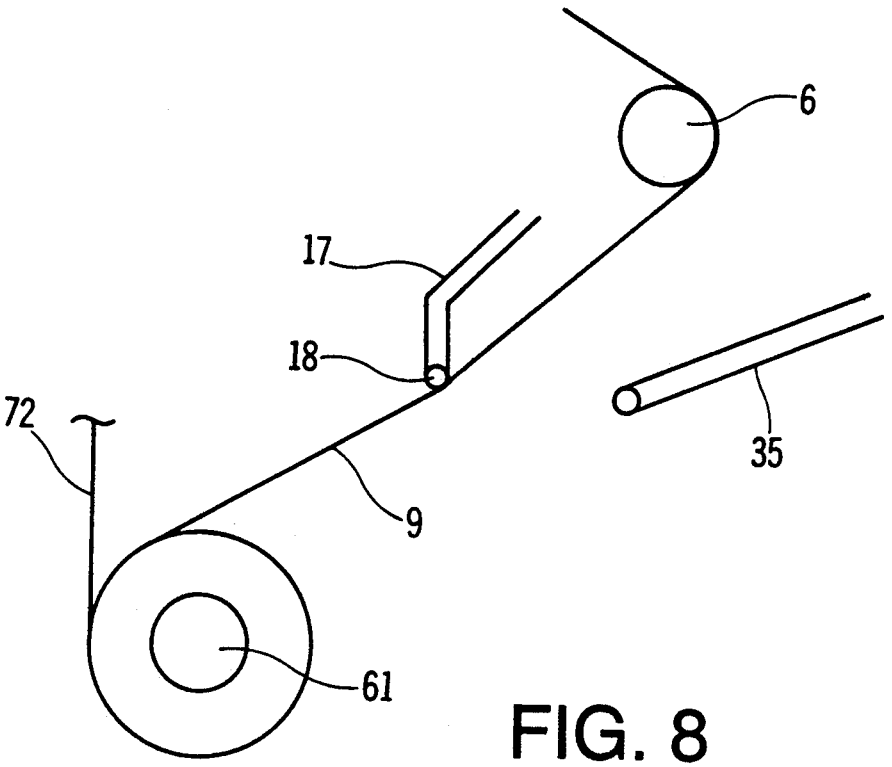

When the front end 9*a* of the belt-like material 9 is wound up onto the take-up shaft 61, the guide belt conveyor 35 stops the movement of its belt and retreats, then the dancer roller member 17 swings downwards, and the dancer roller 18 presses the belt-like material 9 present between the take-up shaft 61 and the roller 6 to impose a certain tension on the belt-like material. Under this tension the belt-like material 9 is wound up onto the take-up shaft 61 (FIGS. 7 and 8)

Figure 9:
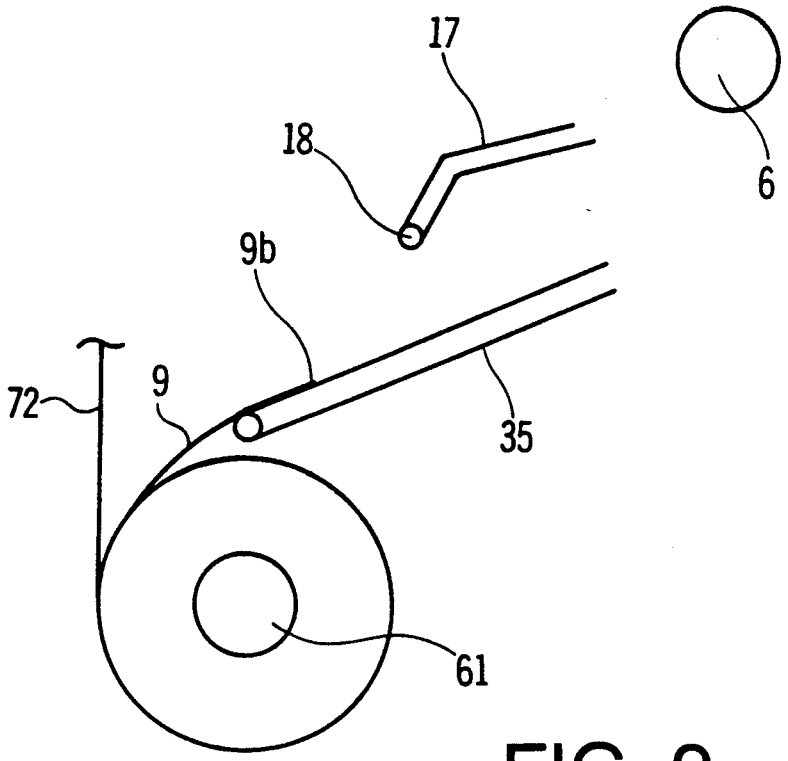
Figure 10:
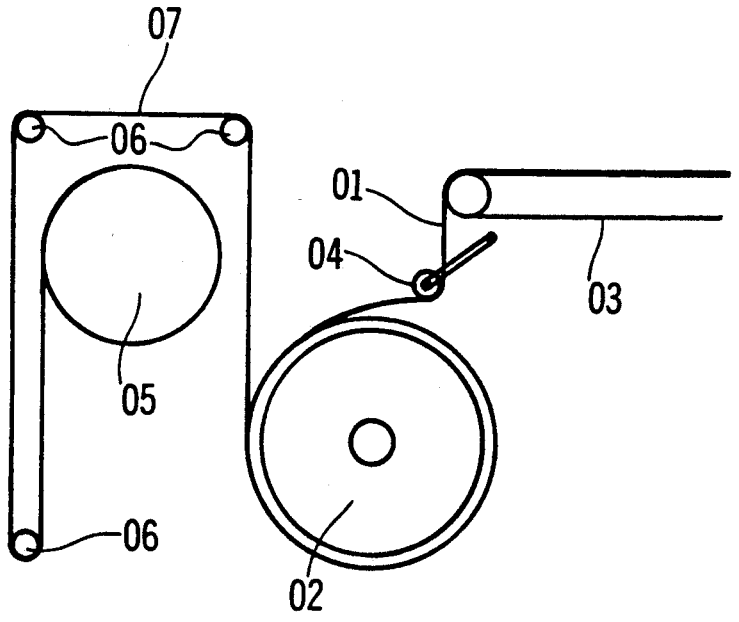
FIG. 10 is a schematic side view of a conventional winding system.
Figure 11:
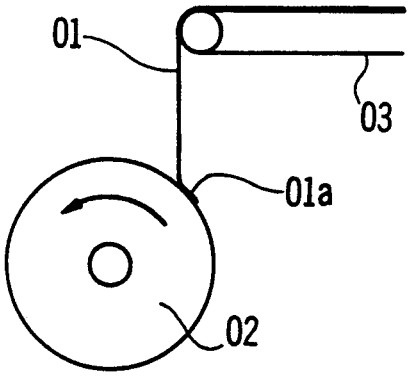
FIGS. 11 and 12 are views showing in what manner a front end portion of a belt-like material is taken up by the conventional winding system.
Figure 12:
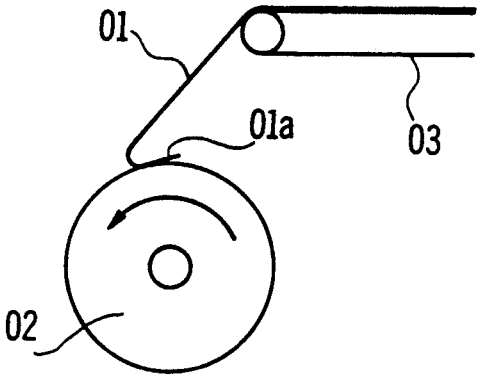
Figure 13:
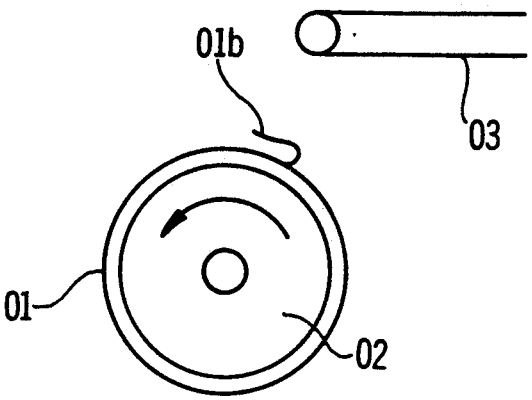
FIG. 13 is a view showing in what manner a rear end portion of the belt-like material is taken up by the conventional winding system.

When the photosensor 10 detects the rear end 9*b* of the belt-like material 9, the dancer roller 18 is raised and the guide belt conveyor 35 moves to receive the rear end 9*b* of the belt-like material, then after catching the rear end 9*b*, guides it up to a predetermined position on the take-up shaft 61 (FIG. 9). At this time, the belt of the guide belt conveyor 35 is driven at low speed to maintain the tension imposed on the belt-like material 9.

Since the guide belt conveyor 35 guides the rear end 9*b* of the belt-like material 9 up to an optimum position not causing bending of the rear end 9*b* when delivered to the take-up shaft 61 side, the foregoing inconvenience caused by bending of the rear end will not occur.

In this way the belt-like material 9 is wound up onto the take-up shaft 61 under a constant tension without bending of its front and rear ends 9*a*, 9*b*. The above take-up operation is repeated at every entry of a platform car, but since each platform car travels only in one direction, it is possible to effect the change of platform cars efficiently.

What is claimed is:

1. A winding system for winding up a long belt-like material onto a take-up shaft in which the belt-like material is fed in a continuous manner by a conveyance device and a front end of the belt-like material hangs down from the conveyance device to be fed to the take-up shaft from above for winding up, including:

guide means for guiding front and rear ends of said belt-like material each into a predetermined position on said take-up shaft, said guide means comprising belt conveyor means mounted for movement in a vertical direction and for reciprocating movement transverse to said vertical direction toward and away from said take-up shaft;

a dancer roller for applying a predetermined tension to said belt-like material being wound up onto said take-up shaft at a position between said take-up shaft and said conveyance device;

a winding drive shaft mounted for movement into and out of driving engagement with said take-up shaft;

rail means extending in a direction substantially orthogonal to said winding drive shaft and extending in opposite directions on both sides of the winding drive shaft;

platform cars each provided with said take-up shaft and moveable along said rail means from one side of said winding shaft to another side; and drive means for advancing and retracting said winding drive shaft in a direction orthogonal to said rail means for engagement and disengagement of said winding drive shaft with said take-up shaft on each of said platform cars upon movement of said cars sequentially along said rail means.

2. A winding system for winding up a long belt-like material which is fed in a continuous manner, onto a take-up shaft, including:

a winding drive shaft adapted to engage and drive said take-up shaft;

first rail means extending in a direction substantially orthogonal to said winding drive shaft and extending in opposite directions on both sides of the winding drive shaft;

second rail means extending in a direction orthogonal to said first rail means;

a support frame mounted for movement on said second rail means and supporting said winding drive shaft;

platform cars each provided with said take-up shaft and mounted for movement along said first rail means from one side of said winding shaft to another side; and drive means for advancing and retracting said winding drive shaft in a direction orthogonal to said first rail means for engagement and disengagement of said winding shaft with said take-up shaft on each of said platform cars upon movement of said cars sequentially along said first rail means.

* * * * *